US006668747B2

(12) United States Patent
Kjerstad

(10) Patent No.: US 6,668,747 B2
(45) Date of Patent: Dec. 30, 2003

(54) LOAD TRANSFER SYSTEM

(75) Inventor: Jostein Kjerstad, Tananger (NO)

(73) Assignee: Seametric International AS, Stavenger (NO)

( * ) Notice: Subject to any disclaimer, the term of this patent is extended or adjusted under 35 U.S.C. 154(b) by 0 days.

(21) Appl. No.: 10/239,248

(22) PCT Filed: Mar. 20, 2001

(86) PCT No.: PCT/NO01/00119

§ 371 (c)(1),
(2), (4) Date: Sep. 20, 2002

(87) PCT Pub. No.: WO01/70616

PCT Pub. Date: Sep. 27, 2001

(65) Prior Publication Data

US 2003/0037716 A1 Feb. 27, 2003

(30) Foreign Application Priority Data

Mar. 22, 2000 (NO) ..... 20001471

(51) Int. Cl.[7] ..... B63B 35/44
(52) U.S. Cl. ..... 114/264
(58) Field of Search ..... 441/4; 114/121, 114/122, 123, 124, 268, 44, 264, 265, 266

(56) References Cited

U.S. PATENT DOCUMENTS

| | | | | |
|---|---|---|---|---|
| 4,067,446 A | | 1/1978 | Ray | |
| 4,207,828 A | | 6/1980 | Horowitz et al. | |
| 4,293,265 A | * | 10/1981 | Luck et al. | 414/137.7 |
| 4,309,955 A | * | 1/1982 | Kentosh | 114/230.14 |
| 4,345,536 A | | 8/1982 | Gregg | |
| 4,426,925 A | * | 1/1984 | Bergmann | 100/65 |
| 4,529,064 A | | 7/1985 | D'Andrea, Jr. | |
| 6,325,012 B1 | * | 12/2001 | Aristizabal | 114/314 |

FOREIGN PATENT DOCUMENTS

| | | |
|---|---|---|
| DE | 615152 | 6/1935 |
| GB | 2 143 195 | 2/1985 |
| NL | 8401162 | 11/1985 |
| NL | 8403467 | 6/1986 |

* cited by examiner

*Primary Examiner*—Stephen Avila
(74) *Attorney, Agent, or Firm*—Finnegan, Henderson, Farabow, Garrett & Dunner, L.L.P.

(57) ABSTRACT

A system for lifting and moving heavy loads, especially for use in the installation or removal of offshore platforms, comprising a number of lifting devices (1) which are arranged for mounting on a floating structure (2) which during use floats on the surface (3) of a volume of water (4) beside the load which has to be lifted. Each lifting device (1) comprises a lever arm unit (5) with a first (6) and a second (7) arm projecting in opposite directions from a common mounting point (8), the first arm having a lifting point (11) at its free end for engaging with the load, at least one first container (12) which is connected to the first arm (6) at a point near the said lifting point (11), and which is arranged to receive and discharge a flowable medium and to be submerged in the volume of water (4), and at least one second container (19) which is suspended at the free end of the second arm (7). The interiors of the containers are interconnected via a pipeline device (21), and a device (22) is provided for fast transfer of medium in the first container (12) via the pipeline device (21) to the second container (19).

8 Claims, 4 Drawing Sheets

LOAD TRANSFER SYSTEM

Figure 1:
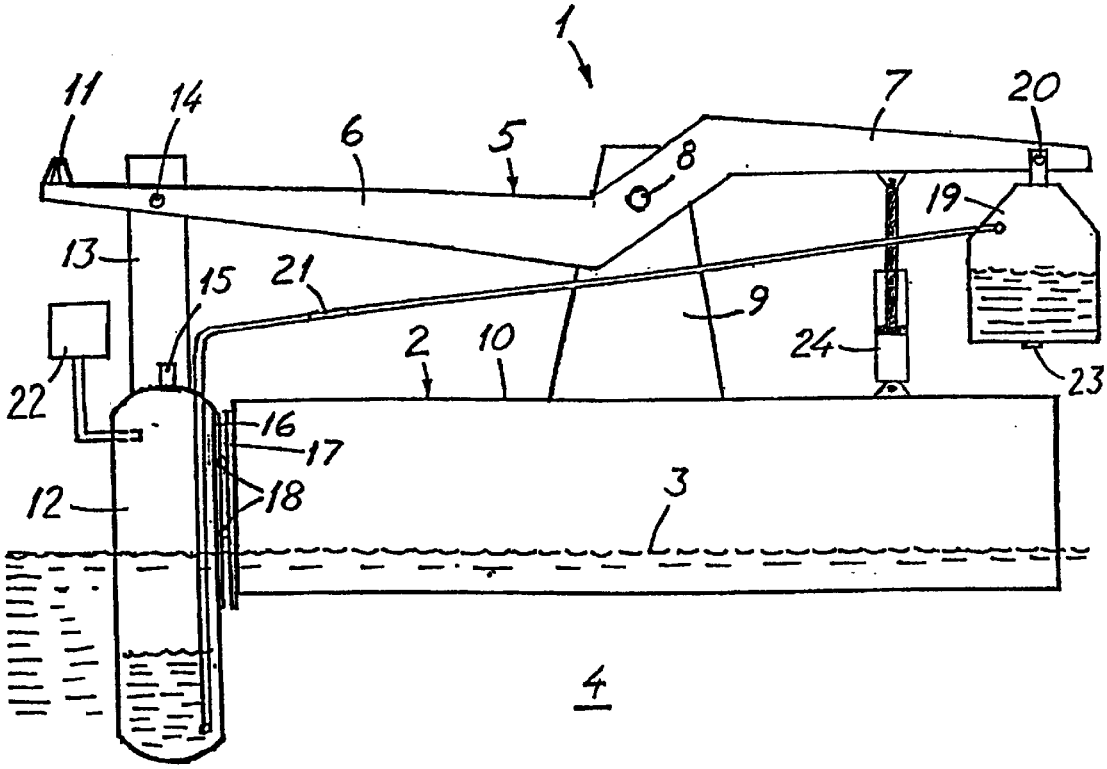

The invention relates to a system for lifting and moving heavy loads, especially for use in the installation or removal of offshore platforms, comprising a number of lifting devices which are arranged for mounting on a floating structure which during use floats on the surface of a volume of water beside the load which has to be lifted.

Various types of systems and devices are known in the prior art for lifting heavy sections during the installation or removal of offshore platforms. Conventional methods used in this connection have usually been based on the use of offshore crane ships or heavy lift vessels. In a typical operation of this kind, a crane ship will be positioned close to a platform and lift the various sections of the platform in a predetermined sequence.

Systems or devices are also known which are designed to lift the entire upper part or deck of a platform in a single operation. Such a system, which is of the type mentioned at the beginning, is the so-called "Versatruss" lifting system. This system is a twin-barge lifting system which is based on two barges which are located at a suitable distance apart oil opposite sides of the structure which has to be lifted, and which are interconnected and can be pulled towards each other with great force by means of winch devices. On each barge are placed a number of lifting beams which are tilted inwards and upwards in the direction of the load, and which are brought into engagement with the load. The two barges are then pulled towards each other, thus causing the angles of inclination of the lifting beams to increase as the distance between the barges decreases, thereby causing the load to be lifted up in tile area between the barges which then forms a catamaran configuration.

This known system is based on custom-built lifting beams which therefore have to be specially made or adapted for each lifting operation. Furthermore, the system is restricted to use in relatively calm waters, without particularly large waves, since very heavy lifts of up to 20 000 tons are involved here, and thus very great forces, with the result that large waves can easily cause serious damage to or destruction of tile equipment, since the system does not possess any kind of heave compensation.

Another known device in this field is the so-called "offshore shuttle". This is a U-shaped unmanned offshore vessel based on tugboats for operational assistance. During installation or removal of platform structures the vessel is ballasted so that it is submerged and surrounds the upper part of the platform or the deck, and then deballasted so that the structure is lifted. A typical "offshore shuttle" may be 150 m long, 80 m wide and 60 in high with a weight of around 12 000 tons. A large structure is therefore involved here. The structure has the advantage of being extremely stable in a submerged condition, in the same way as a semi-submersible structure or "semi-sub". However, this principle requires a corresponding depth at the application site.

In practice the hitherto known concepts, which are based on the semi-sub principle or on two interconnected vessels in a catamaran configuration, will be faced with serious problems. In the case of a semi-sub, one of the main problems is the time it takes to evacuate the ballast to a point where the semi-submerged structure makes contact with the object which has to be lifted, and the time it takes to perform the lift. The problems involved are naturally associated with the heaving motion experienced by the floating objects as a result of wave action.

As mentioned above a semi-sub will be relatively stable and relatively little affected by waves. Assuming, however, that the waves have an influence, the mass forces which are set in motion will have to be absorbed when tile floating structure encounters the object which has to be lifted. The serious consequences involved can easily be imagined if such a floating structure (12000 tons) should experience a heaving motion of 1 m and hit a platform deck on the way up from a wave trough.

The second problem which may be encountered is when there is a failure to perform a lift to a safe height within a wave period when using a semi-sub solution or a two-vessel system. The consequence thereof can be that tile load (the platform deck) is replaced on the foundation from which it was lifted, thereby causing damage or possibly losing the entire lift, or that an acceleration is experienced during installation as a result of faulty "timing".

A further problem in connection with such lifting operations is the uncertainty which reigns concerning the distribution of weights on a platform deck. In earlier times there was no adequate documentation and control of the building process, nor were the subsequent modifications to the platforms completely documented. This can lead to ignorance of the platform deck's centre of gravity, with the result that a controlled deballasting, of the floating structures cannot be prepared in order to take this factor into account. The consequences can be a tilted lift, or in the worst case failure to perform the lift.

In view of this, it is an object of the invention to provide a system which has substantial lifting power and inherent heave compensation, where the system can control the forces transferred to the lift object during the entire lifting operation, and a lift to a safe height can be accomplished within a wave period, with the result that the system is suitable for lifting extremely heavy loads while being reliable in operation.

A second object of the invention is to provide a system of this kind which is cost-effective and module-based, thus enabling several lifting devices to be connected together as required.

In order to achieve the above-mentioned objects, a system is provided of the type mentioned in the introduction which according to the invention is characterized in that each lifting device comprises a lever arm unit with a first and a second arm projecting in opposite directions from a common mounting point, the first arm having a lifting point at its free end for engaging with the load, at least one first container which is connected to the first arm at a point near the said lifting point and which is arranged to receive and discharge a flowable medium and to be submerged in the volume of water, and at least one second container which is suspended at the flee end of the second arm, the interior of the container being connected via a pipeline device, and a device is provided for fast transfer of medium in the first container via the pipeline device to the second container.

The system according to the invention is cost-effective since it is based on the use of floating structures in the form of existing barges or other suitable vessels which can be hired. The lifting devices will be prefabricated and modular, thus enabling the system to be easily transported to the site where a lifting operation has to be performed. A typical system for lifting a platform will be comprised of two barges in a catamaran configuration, with two or more lifting devices located on each barge. It may be expedient to provide a hydraulic auxiliary system with hydraulic cylinders which are connected between respective lever arm units and the floating structure in order to ensure that interacting lever arms are lifted in parallel and uniformly, and thus enabling the lift can be carried out in a controlled manner.

By combining a floating structure with substantial load capacity with one or more partly submerged containers in the manner indicated, the advantage of both stability and lifting power is obtained, thus providing minimal movement in the water and maximum lifting power. By transferring the force in the manner indicated by means of weight transfer from the partly submerged containers at one end of the lever arm unit, a passive heave compensation is obtained and particularly a progressive heave compensation as the containers are increasingly submerged.

Figure 2:
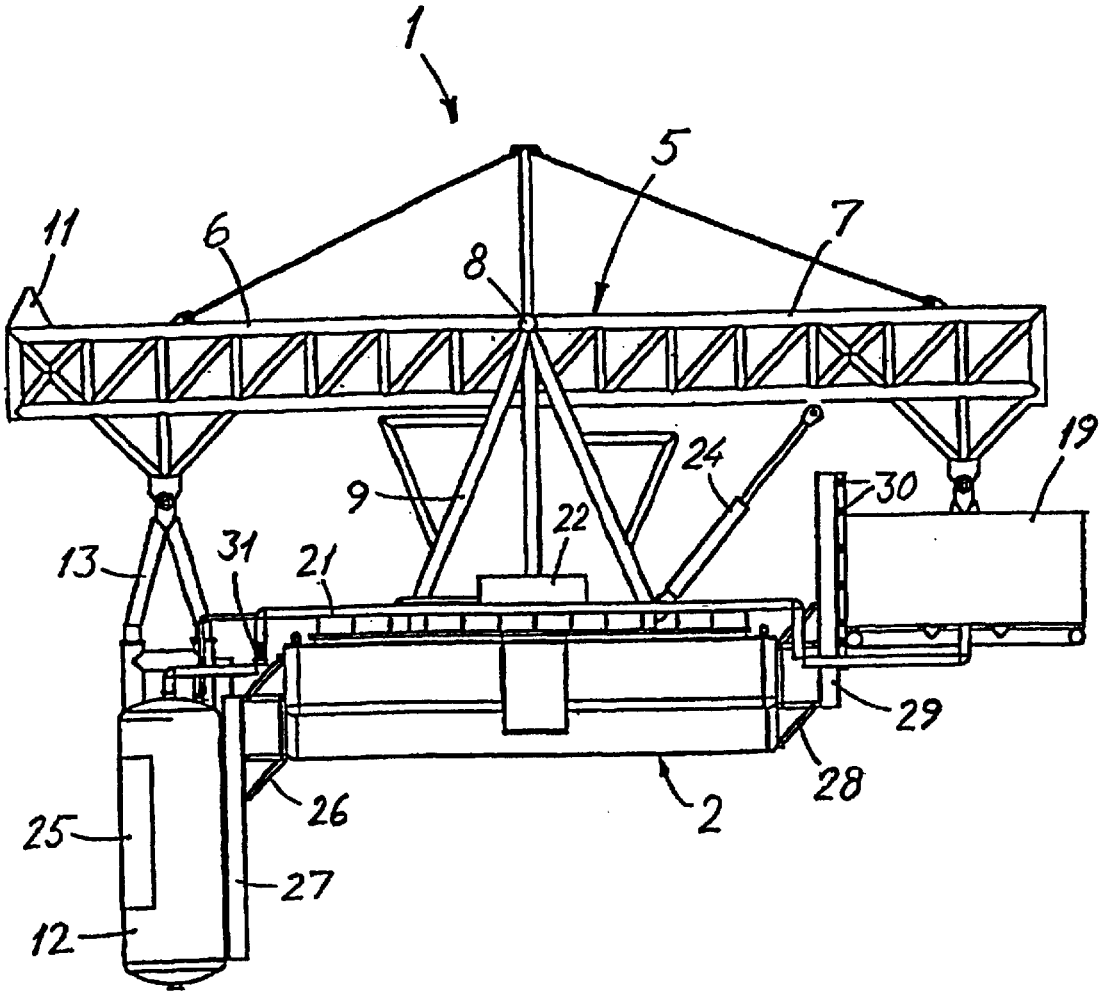
Figure 3:
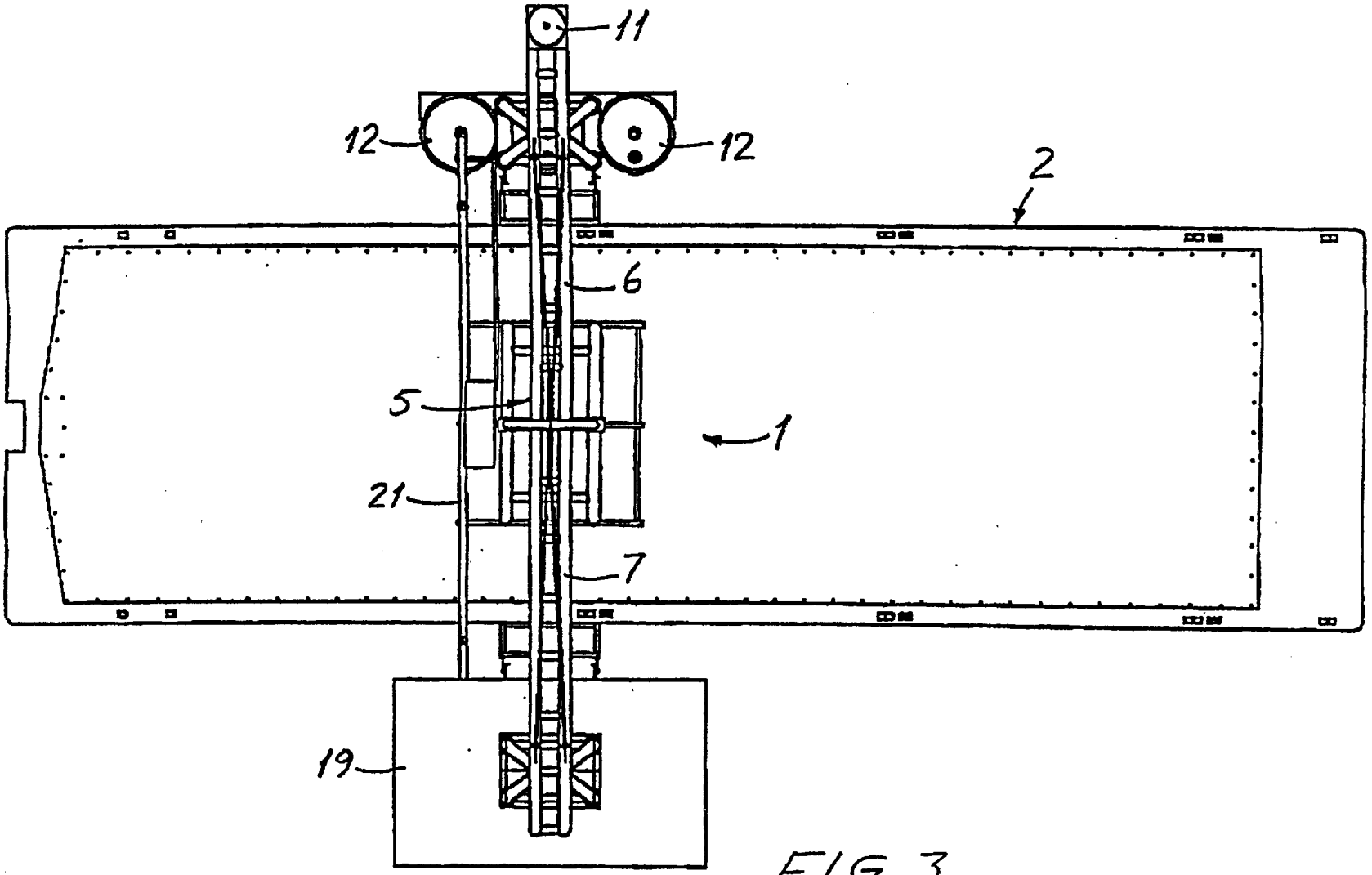
Figure 4:
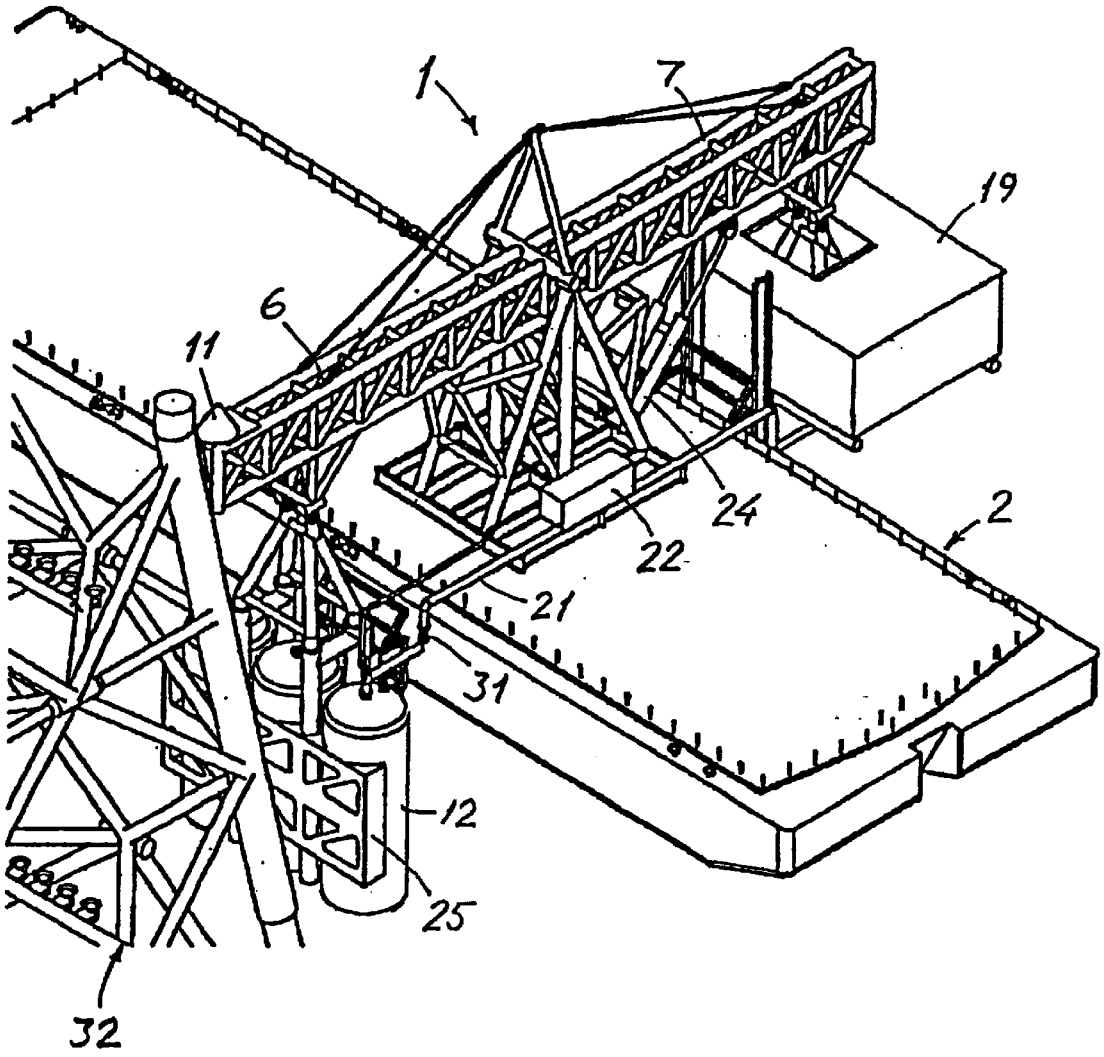

The invention will now be described in greater detail in connection with an embodiment with reference to the drawings, in which FIG. 1 is a schematic side view of a system according to the invention, FIGS. 2 and 3 are a side view and a top view respectively of an embodiment of the system according to the invention, and FIG. 4 is a perspective view of the system in FIGS. 2–3, where the lifting device has been brought into position beside a part of a platform which has to be lifted by means of the system.

In the drawings, corresponding parts and elements in the different figures are indicated by identical reference numerals.

The schematic view in FIG. 1 illustrates a system according to the invention where a lifting device 1 is mounted oil a floating structure in the form of a barge 2 floating on the surface 3 of a volume of water 4. The lifting device comprises a lever arm unit 5 with a first arm 6 and a second arm 7 projecting in opposite directions from a common mounting point 8 in a support structure 9 which is advantageously located in the centre of the barge's 2 deck 10, preferably with the mounting point's 8 axis of rotation located in the vertical plane through the barge's longitudinal centre line. The system will thereby convey the load down into the centre of the barge, or generally in the centre of the floating structure employed, without causing any rolling motion on the floating structure.

The first arm 6 is provided at its free end with a lifting point 11 for engaging, with a corresponding or complementary lifting point on the structure which has to be lifted.

The device further comprises a first container or tank 12 which is connected via a load-transmitting part 13 with the first arm 6 at a point 14 near the lifting point 11 at the arm's free end, or possibly more or less coinciding with the lifting point. The container 12 has an internal volume for receiving a desired amount of a flowable medium, such as water, or possibly a suitable sludge. The container is provided with an upper inlet device 15 for supply of medium. As illustrated, the container is partly submerged in the volume of water 4, with the result that it is influenced by a corresponding buoyancy. The container is vertically movable along the adjacent outer side of the barge 2. For control of the container's movement, between the container and the said outer side of the barge there is mounted a guide device which is shown in the form of guide rails 16, 17 and intermediate rollers 18.

The container 12 may advantageously be designed with an upper portion with reduced cross section, with the result that in its submerged state it has relatively little waterline area in the wave zone. This will help to increase the stability of movement in the water in a similar manner to a partly submerged object (semi-sub).

The device further comprises a second container or tank 19 which is suspended in a suspension point 20 at the free end of the second arm 7. The interior of the second container 19 is connected to the interior of the first container 12 via a pipeline device 21 for transfer of medium in the first container 12 to the second container 19, or vice versa. The system demands fast transfer of the medium or liquid volume concerned and this can advantageously be achieved by means of compressed air, or another suitable pressure gas. For this purpose the container 12 is connected at its upper end with a compressor unit 22 with associated storage tanks for pressurising the interior of the container with compressed air (or pressure gas). The compressor unit must have sufficient capacity to ensure transfer of the volume of medium concerned (e.g. approximately 400 tons) in tile course of a few seconds. If the medium employed is water, the water volume, which is transferred to the second container 19 during a lifting operation is drained out of the container via a suitable outlet 23. Instead of a compressor system a suitable pumping system may be employed.

As illustrated in FIG. 1, a hydraulic cylinder-piston unit 24 is connected between the barge's 2 deck 10 and the lever arm unit's second arm 7. The unit 24 represents an auxiliary system which may be applied particularly when several lifting devices are arranged beside one another on the barge, working in parallel. By means of suitable activation of the units concerned 24 during a lifting operation, a corresponding downwardly-directed additional force can be achieved on the second arm 7, and a corresponding additional lifting force in the lifting point 11. This may be necessary in the case of unequal weight distribution of the load which has to be lifted, in order to achieve parallel lifting movement and a controlled lift.

The hydraulic auxiliary system 24 may also be arranged to determine the lever arms' turning angle, and thereby the suitable lifting height for the lifting point 11 during the performance of a lifting operation. As an alternative, the auxiliary system may be connected between the first arm 6 and the barge deck 10, in order to exert a desired additional force on the arm.

When a lifting operation is carried out with the present system, the barge 2 is positioned in such a manner that the lifting point 11 remains located under the corresponding lifting point on the load which has to be lifted. To begin with, the container 12 will be filled with a suitable medium with a weight corresponding to the volume of water in the water 3 which is displaced by the container in the submerged position, with tile result that the lever arm unit 5 is in balance. When the barge is in the correct position, at least a part of the medium, for example water, in the container 12 is rapidly transferred to the container 19 at tile lever arm unit's second end. If a water volume of, e.g., 400 tons is transferred, this will result in a corresponding upwardly-directed force on the lifting point 11, assuming a lever arm ratio of 1:1. Since the container 12 will still essentially be submerged as before, despite the lifting movement achieved, the buoyancy force comes in addition to the said lifting force of 400 tons, thus giving a total lifting force of 800 tons.

By employing, a suitable choice of lever arm ratio other than one, a corresponding increase in lifting force can be obtained. This can be achieved by means of a suitable extension of the second arm 7, i.e. without a reduction in tile length of the first arm 6, and thereby the same lifting height is achieved as before.

On account of the lever arm's rotational movement about the axis of rotation 8, the lifting point 11 at the end of the arm 6 will move along a circular path about the axis of rotation. Even though this involves a circle with a relatively large radius of approximately 20–30 m, it may be necessary to compensate for the small deviation from vertical movement of the lifting point 11. This can be accomplished in various ways, e.g. by means of sufficient tolerance in the engagement between the lifting point and the complementary lifting point on the load which has to be lifted. The lifting point 11 may be provided with limited movement (longitudinal or rotatable) on the arm 6.

An embodiment of the system according to the invention, as it may be constructed in practice, is illustrated in FIGS. 2–4.

As illustrated in the figures, in this embodiment the lever arm unit 5 is composed of a truss construction which extends substantially outside tile barge 2 on each side thereof, with the lever arm unit's arms 6, 7 extending across the barge's longitudinal direction. In this embodiment a group of three first containers 12 is provided, the containers being attached to a support frame 25 which is connected to the load-transmitting part 13. A guide frame 26 is attached to the adjacent outer side of the barge 2, and is connected to suitable guide elements, for example rollers (not illustrated in more detail) which are engaged with respective vertical guide rails 27 which are attached to and extend along respective containers 12, to permit the necessary, vertical movement of the containers.

Here, the second container 19 is in the form of a large, square tank whose vertical movement is controlled by a guide device in a similar manner to the containers 12. The guide device here consists of a frame 28 which is attached to the adjacent outer side of the barge 2, and which is attached to vertical guide rails 29 for control of suitable guide elements 30 for vertical movement of the tank 19.

As illustrated in FIGS. 2 and 4, the pipeline device 21 between the containers 12 and the tank 19 is provided with a flexible portion 31, with a view to the vertical movement of the containers 12.

With regard to the dimensions of the barges which are suitable for use in the system according to the invention, these normally have a length of 97 m, a width of 27 mn and a height of 6 m. Even though in the illustrated embodiment of the system a barge is employed in other cases it may be appropriate to use another type of vessel, a rim, or possibly a semi-submersible structure.

A typical configuration for the system according to the invention may comprise two lifting devices 1 which are arranged side by side on a barge 2 which is suitable positioned at one side of a platform section 32 which has to be lifted by means of the system, as indicated in FIG. 4. An additional barge, which is not illustrated in FIG. 4, will be located in a similar manner on the opposite side of the platform section 26, and will be provided with two lifting devices 1 which are arranged in a similar manner side by side on the barge. The lifting operation concerned will be performed in a similar manner to that described above, the lifting devices' lifting points being connected to corresponding lifting points (not shown) at the corners of the platform. Similar hydraulic auxiliary systems to the above-mentioned auxiliary system 24 may be provided, and will be activated as required, for example in case the platform section should have an unequal weight distribution and thereby a different weight in the corner areas.

As will be realised from the foregoing description, the system according to the invention has a number of unique and advantageous characteristics. These can be summarised as follows:

The system does not transfer greater loads than those permitted (depending on the volume of liquid in the first and second containers, and the buoyancy of the submerged containers) to the object which has to be lifted. This applies from the first contact until the lift is completed. The system is self-regulating since the lift object is gripped by a lever arm which will be balanced at all times. If the floating structure experiences all upwardly-directed movement as a result of wave influence the lever arm at the point of application will give way while still being capable of transferring forces corresponding to tile weight/buoyancy ratio between the first and second containers.

Heave compensation is achieved as a result of the above, and as a result of the partly submerged containers.

A lift can be carried out to a safe height in the course of a wave period. (A safe height will be determined by the ratio between the lifting speed and the wave period, thus avoiding conflict between the lift object and the supporting base after the lift is initiated). The reason for the system being able to achieve this is the dual effect obtained by moving the liquid between the containers, and the fact that the container or containers which initially contain the liquid are partly submerged in water, and that by means of gas or pumps a sufficient volume of liquid is moved within a given period of time.

The system takes account of the fact that the lift object does not necessarily have its centre of gravity in the centre, and there is therefore a risk of tilting during the lift. This results from the fact that by means of the volume of liquid in the containers the force can be determined by which the arms should grip the lifting points on the lift object, in order to keep the lift object in a horizontal position.

The system will further be able to keep the lift object in an approximately horizontal position even though the effect of a wave influences the floating structure. This is due to the fact that at all times a balance will be maintained of the forces influencing the lever arms from the wave forces, and the forces influencing the arms from the lifted object through the lever arms.

The control of the liquid transfer between the containers on the various lever arms can be regulated by load cells placed at strategic points between the object which has to be lifted and the base away from which the object has to be lifted, thus providing a continuous measurement of the forces applied to the lifting object via the arms, and thereby also controlling the lifting of the object in a horizontal position.

What is claimed is:

1. A system for lifting and moving heavy loads, especially for use in the installation or removal of entire or parts of offshore installations, comprising a number of lifting devices (1) which are arranged for mounting on a floating structure (2) which during use is located beside the load (26) which has to be lifted, characterized in that each lifting device (l) comprises a lever arm unit (5) with a first (6) and a second (7) arm projecting in opposite directions from a common mounting point (8), the first arm (6) having a lifting point (11) at its free end for engaging with the load (26), at least one first container (12) which is connected to the first arm (6) at a point near the said lifting point (11), and which is arranged to receive and discharge a flowable medium and to be submerged in a volume of water (4), at least one second container (19) which is suspended at the free end of the second arm (7), the interiors of the containers (12, 19) are interconnected via a transferring device (21).

2. A system according to claim 1, characterized in that a device (22) is provided for transferring medium between the first container (12) via the transfer device (21) to the second container (19).

3. A system according to claim 2, characterized in that transfer of medium is undertaken by a compressor unit (22) for pressurising the interior of the first container (12) with compressed air.

4. A system according to claim 1 or 3, characterized in that a guide device (16, 17, 18) for vertical movement of the container (12) is arranged between the container and an adjacent outer side of the floating structure concerned (2).

5. A system according to one of the claims 1, characterized in that between the lever arm unit's (5) second arm (7) and the floating structure (2) there is arranged a hydraulic cylinder/piston unit (24) which is arranged to exert a force on the second arm (7).

6. A system according to claim 5, characterized in that the hydraulic cylinder/piston unit (24) is arranged to determine the lever arms' (6, 7) turning angle, and thereby the lifting point's (11) lifting height.

7. A system according to claim 1, characterized in that it comprises a number of floating structures (2) which during use are each located on one of two opposite sides of the load (26) which has to be lifted.

8. A system according to claim 7, characterized in that it comprises four lifting devices (1) which are mounted two by two beside one another on the respective barge (2), the device's lifting points (11) being adapted for engagement with a respective corner portion of the load (26) which has to be lifted.

* * * * *